United States Patent [19]

Schiemann

[11] Patent Number: 4,928,861

[45] Date of Patent: May 29, 1990

[54] PLASTIC-CANISTER SCREW CLOSURE

[76] Inventor: Wolfram Schiemann, Eugen-Nagele-Strasse 17, 7140 Ludwigsburg, Fed. Rep. of Germany

[21] Appl. No.: 295,052

[22] Filed: Jan. 6, 1989

[51] Int. Cl.[5] ..... B67D 3/00

[52] U.S. Cl. ..... 222/481.5; 222/189; 222/568

[58] Field of Search ..... 222/189, 188, 563, 566, 222/571, 108, 109, 478, 481.5, 481, 568; 215/307, 308, 309, 310

[56] References Cited

U.S. PATENT DOCUMENTS

| | | | |
|---|---|---|---|
| 2,835,411 | 5/1958 | Scheminger, Jr. | 222/481 |
| 3,149,758 | 9/1964 | Bush et al. | 222/189 |
| 3,399,811 | 9/1968 | Miller | 222/481 |
| 3,622,049 | 11/1971 | Thompson | 222/189 |
| 4,585,150 | 4/1986 | Beacham et al. | 222/481.5 |
| 4,699,300 | 10/1987 | Blake | 222/481 |

*Primary Examiner*—Joseph J. Rolla
*Assistant Examiner*—Kenneth Noland

[57] ABSTRACT

At the place where the venting through hole of canisters with an external screw thread opens out at the pouring nozzle, a screw-on cover has an annular groove which is liquid-tight with respect to the liquid flowing out from the pouring nozzle. The annular groove in turn communicates by a through air hole with the outside air, so that air can flow into the canister to compensate for the liquid flowing out. Larger canisters in particular can be poured out quickly and without glugging.

20 Claims, 2 Drawing Sheets

PLASTIC-CANISTER SCREW CLOSURE

The invention relates to a screw closure for a plastic canister that has a pouring nozzle with an external screw thread.

BACKGROUND OF THE INVENTION AND RELEVANT PRIOR ART

When a canister is emptied, sooner or later as much air has to flow in as liquid flows out from its pouring nozzle. The most common canisters are 5 liter canisters, 10 liter canisters and 20 liter canisters. Of course, these liter figures are only approximate and need not be precisely correct. The 5 liter and 10 liter canisters of plastic are only available with screw closure, because a claw closure would be too elaborate in this case, and for other design reasons. In the case of the 5 liter canister, often there is the chance of glugging, which disrupts the pouring operation and is due to the fact that when there is sufficient negative pressure in the canister the air is sucked-in through the pouring spout, during which time no liquid, or very little liquid, can flow out from the pouring nozzle.

There are a considerable number of pouring nozzles for 5 liter and 10 liter canisters which have air return tubes inside. If no liquid is to pass through these, but air is to flow in, they must be at the top during pouring. There are two approaches as to how to accomplish this:

(a) The manufacturer of the canister always produces the external screw thread—and has done so for many years—such that the start of the thread is always in the same place. With such a canister he supplies a pouring spout, the screw socket with internal thread of which, firmly connected to the spout, has such an internal thread that, with pouring spout tightened liquid-tight, the air tube is at the top. This has the disadvantage that production has to be kept very accurate. In addition, the pouring spout—even if it is injection-molded—is nevertheless so compliant in the thread region that the screwing movement cannot be stoped exactly when the air tube is at the top. The angled-off end region of the pouring spout then faces to the side. Such inaccuracies in the screwing end stop may also be due to the fact that the seal wears out, is lost or the like.

(b) Two-part pouring spouts are produced in which the screw ring is a separate part. Then the spout can in fact be held firm in the correct position. The start of the external thread is thus not critical in this case. There is the disadvantage, however, that many people are uninformed about flow conditions and, in spite of the actually existing possibility of doing it correctly, the air tube is not at the top. In addition, a two-part design, with all its disadvantages such as sealing points, stock keeping, loseability, etc., suffers considerable disadvantages. The two parts also have to be produced by different technologies. The screw socket must be injection-molded, while the actual spout is usually blow-molded. Examples of the different pouring spouts which can be screwed on to screw-on closures of plastic canisters are found, for example, in West German Utility Model 1808610, in German Patent Specification 3508320, in German Patent Specification 1930906.

In the case of 20 liter canisters, the air return can only be disregarded as far as low-grade canisters are concerned. For industrial purposes, military purposes or the purposes of emergency services, the canisters must have an air tube which reaches from the pouring nozzle into the rear regions of the canister. The canister's own venting opens out in the end face of the pouring nozzle, and if the pouring device likewise has claws, the spatial relative arrangement of a certain place on the end face of the pouring nozzle and any air tube there may be in the pouring spout is provided as a matter of course. The air flowing in then reliably flows from the mouth of the spout to the end of the canister's own air tube.

However, claw closures are expensive. Some people do not understand their operation. They have more individual parts than screw closures. A screw-on spout has, however, the threading disadvantages mentioned above in relation to 5 liter and 10 liter canisters, and consequently it is not possible to empty a screw-closure canister in a simple way. This is of much greater disadvantage with 20 liter canisters than with 5 liter and 10 liter canisters, because in the case of the former it takes much longer until it is empty.

OBJECT AND STATEMENT OF THE INVENTION

The object of the invention is to provide a screw closure by which such canisters can be emptied easily, the pouring nozzles of which bear a screw closure with an external thread.

Screw closures of the type described have a screw closure shroud with an internal thread complementary to the external screw thread on the plastic canister and coaxial to a geometrical longitudinal axis of the screw closure. The screw closure also has a bottom substantially perpendicular to the geometrical longitudinal axis, a coaxial annular wall having an outer wall region, emerging from the bottom and extending a distance shorter than the shroud, and a coaxial sealing ring with an inner region held in defined contact by the outer wall region of the annular wall and defining a sealing plane for the pouring nozzle.

According to the invention, the object of the invention is achieved by the following features:

(a) the annular wall is firm against radial pressure directed onto the geometrical longitudinal axis, (b) on the far side of the sealing ring relative to the sealing plane, the screw closure bottom has an annular channel that is arranged coaxially, is open away from the screw closure bottom and extends widthwise between the annular wall and the shroud, (c) at least one through air hole is provided in the screw closure bottom, one end of which communicates with the annular channel, (d) a liquid outflow hole is provided in the screw closure bottom within the annular wall, and (e) downstream of the liquid outflow hole, a flexible pouring spout is connected in liquid-tight manner to the screw closure.

Additionally, the invention includes the following advantageous features:

The annular wall is solid. This feature achieves the effect that the annular wall does not yield to the pressure which occurs during screwing of the device onto the pouring nozzle. It is then not necessary to strengthen the annular wall in another way, for example by inserted reinforcing rings or the like.

The annular wall has a free end region and on its outside in its free end region an introductory chamfer for an inner wall of the pouring nozzle. These features make it easier for the device to find its position relative to the screw closure.

The sealing ring is of a size that does not cover at least substantial regions of the annular channel. This feature allows the sealing ring to be made small and prevents it inadvertently covering the canister-side vent opening, and the air flow resistance remains sufficiently small.

The sealing ring has an outer wall region that reaches at most up to the inner rim of the annular channel. This feature keeps the annular channel completely clear.

The sealing ring is an O-ring, the outer wall region of the annular wall holding the O-ring is a coaxial annular groove, and the O-ring lies in the annular groove under prestress. These features provide an optimum sealing ring, which is offered on the market as a standard product, which is well-sealed with respect to the annular wall as well, which is easy to keep and which, due to its round shape, has a slide-on side, so that it adapts easily to different forms of the inner, downstream corner region of the pouring nozzle.

The annular wall has a free end region with an outside with an introductory chamfer, and a short, coaxial, circular-cylindrical centering wall is provided between the chamfer and the annular groove. These features reduce the risk that the O-ring slips out from its annular groove. In addition, the centering wall centers in the pouring nozzle.

The annular channel extends 360 degrees and a single air hole is provided. These features make it easier to produce the annular channel. All that is needed is a single air hole. The air can flow to the air hole from both sides. This solution is easier to provide than a plurality of annular channel segments which do not intercommunicate, or only to a small extent, and then to provide just as many air holes.

A liquid strainer is provided between the outflow hole and the screw closure-side end of the flexible pouring spout. This feature allows the necessary strainer to be accommodated easily and in a secure position.

The screw-closure bottom has an outside surface with a liquid-tight holding socket for the pouring spout. This feature provides a buckling-resistant transition from the screw closure bottom to the pouring spout and a sufficiently long distance to take care of liquid-tightness and to accommodate the strainer.

The screw closure is integral with the exception of the liquid strainer, the sealing ring and the pouring spout. This feature provides a very stable device, which is much more stable than a multi-part device. It is also easier to produce.

The screw closure is injection-molded from plastic. This feature makes the device also mechanically stronger, although it can also be blow-molded for example.

The screw closure has externally the shape of screw closures with circumferential gripping protuberances. This feature allows on the one hand little rethinking to be necessary in operation and on the other hand to a great extent those designs for injection molds or blow molds to be retained which are also used with the known screw closures, so that mold making becomes easier. In the optimum case, there is then little change in many respects from the hitherto usually used sealing screw closures.

The screw closure has the characteristic dimension of 20 liter canister screw closures and is injection-molded from plastic. These features allow these advantages to be applied to 20 liter canister technology. Then the pitch of the thread turns does not have to be recalculated, the contact pressure conditions are known, as is the space requirement of the canister with the device according to the invention or else with a sealing screw closure, and it can be assessed whether the injection molding has constrictions or not, etc.

The wall thickness of the annular wall in the region of the centering wall is 8 mm plus/minus 60%. On 20 liter canisters, the annular groove is 2.5 mm plus/minus 60% deep and 8 mm plus/minus 60% wide. On 20 liter canisters, the center of the annular groove lies at a diameter of 35 mm plus/minus 5 mm. These features lead to designs which have proved very successful for a 20 liter canister without excessively weakening the screw closure bottom, without using too much material and without excessively increasing the resistance to outflow.

DESCRIPTION OF THE DRAWINGS

The invention is now explained with reference to a preferred exemplary embodiment.

In the drawing.

DESCRIPTION OF A PREFERRED EMBODIMENT

Figure 1:
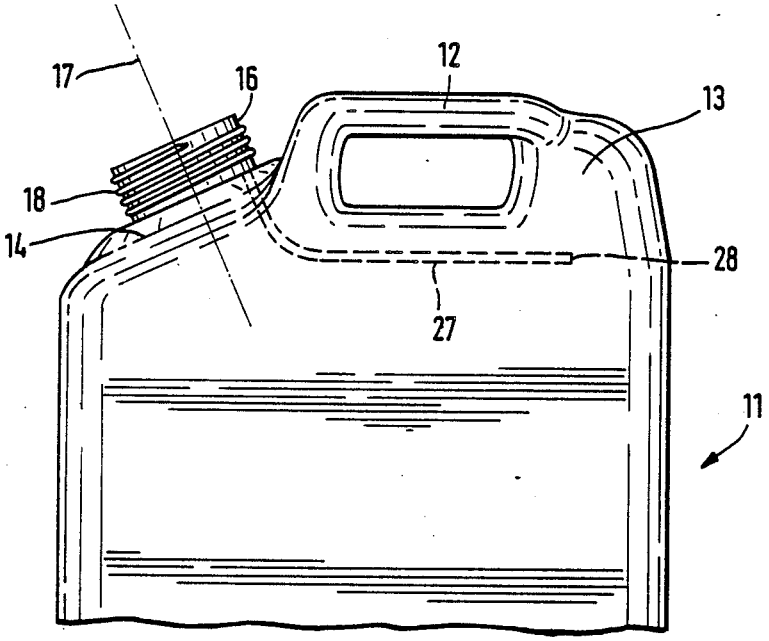
FIG. 1 shows the side view of a three-handle canister, partly broken away, and with a venting tube, but without its screw closure cover.
Figure 2:
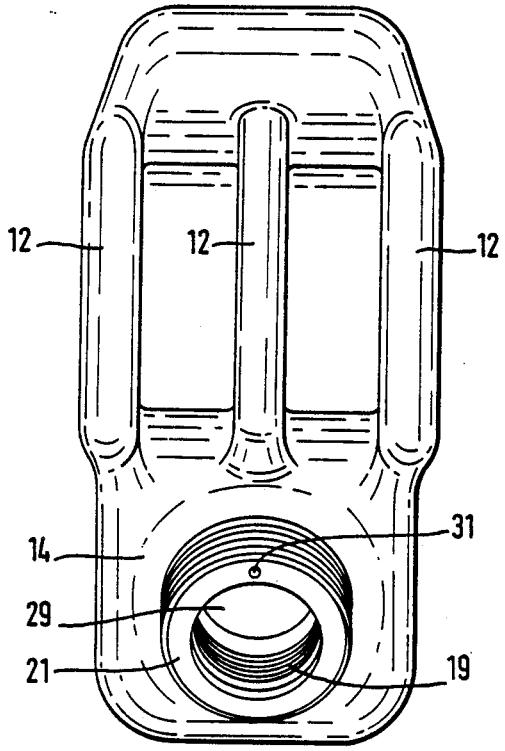
FIG. 2 shows the plan view equivalent to FIG. 1.

A canister 11, blow-molded from plastic, has a nominal capacity of 20 liters. It has three handles 12, which merge at their rear end with a bulge 13. Their front end merges with a bevel 14, from which a pouring nozzle 16 emerges, which is substantially rotationally symmetrical with respect to a geometrical longitudinal axis 17. The pouring nozzle bears an external screw thread 18, which is relatively coarse, and a finer internal thread. The pouring nozzle 16 has an outside diameter (without the height of the thread turns) of 82 mm and the clear diameter in the region of the internal thread 19 is 56 mm. The internal thread 19 reaches not quite up to the end face 21 of the pouring nozzle 16. Rather, according to FIG. 3, there is between the end face 21 and the internal thread 19 a run-out 22 for the last turn of the internal thread 19, into which run-out 22 there also reach however the outermost helical regions of the final internal thread turn. The run-out 22 is thus not a smooth, level recess which is completely rotationally symmetrical with respect to the longitudinal axis 17. In the about 1 cm thick wall 23 of the pouring nozzle 16 there is, according to FIG. 2, at about 12 o'clock a through hole 24, which opens out into the end face 21 and continues on the inside of the bevel 14 in a plug-on peg 26. Fitted onto it is a rigid venting tube 27, the inner end 28 of which opens out in the region of the bulge 13, that is in a region which, with a normally filled canister 11 tilted for pouring, lies somewhere in the residual air of the canister 11. If such a canister is poured out, liquid flows out of the opening 29 of the pouring nozzle 16. At the opening 31 of the pouring nozzle 16, air is sucked in, which flows through the through hole 24, through the venting tube 27 to the end 28.

Figure 3:
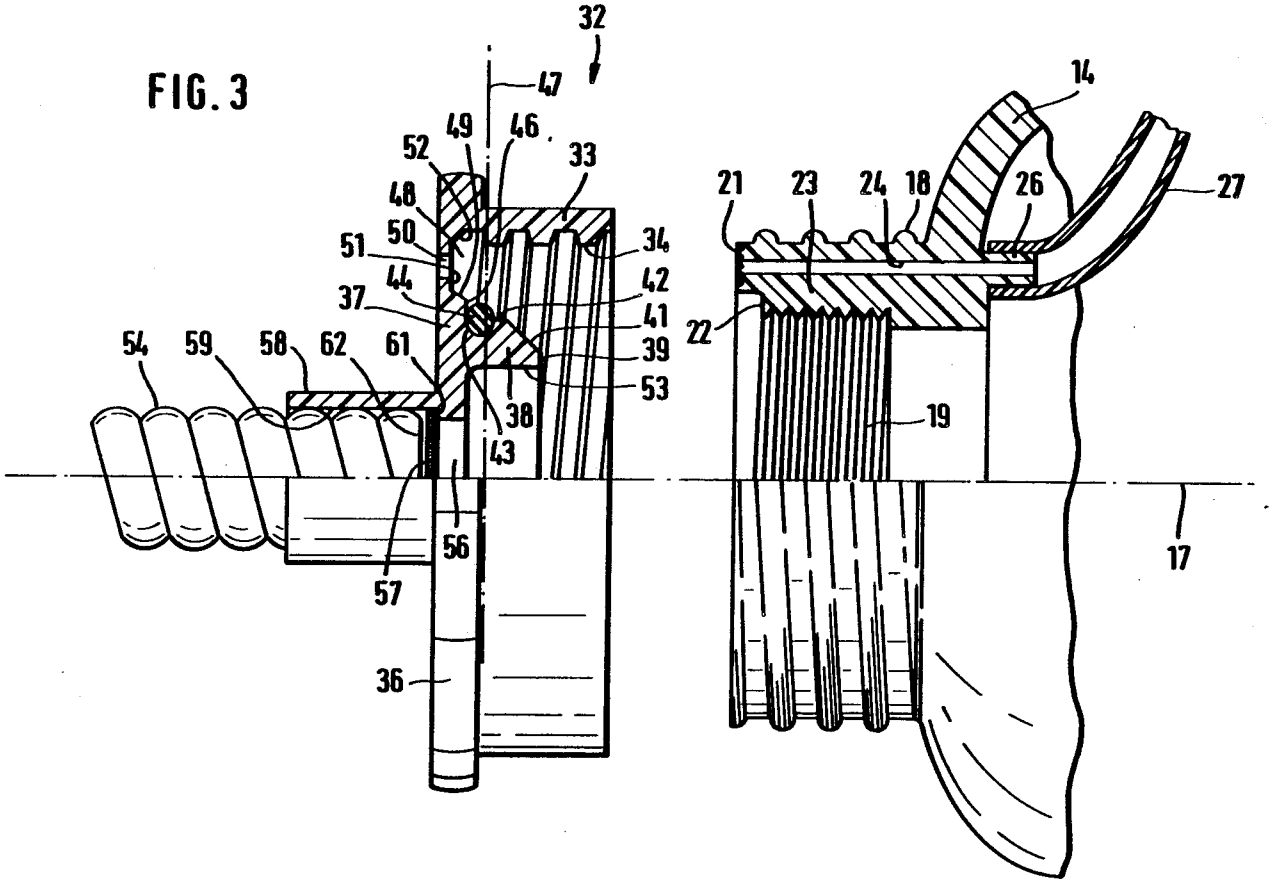
FIG. 3 shows a representation of the device according to the invention, partially in section and broken away, before screwing onto the pouring nozzle of the canister, which is represnted as partially broken away and in section.

According to FIG. 3, a device 32 has a shroud 33, which is coaxial to the geometrical longitudinal axis 17 and bears on its inside an internal thread 34, which can be screwed onto the external thread 18 of the pouring nozzle 16. In the left outer end region, the shroud 33 bears the usual protuberances 36, which serve for the better transference of force for the hand of a user. The shroud 33 merges with a bottom 37, which is perpendicular to the geometrical longitudinal axis 17 and from which an annular wall 38 emerges integrally to the right, according to FIG. 3. All regions of the annular wall 38 are coaxial to the longitudinal axis 17. An end face 39 is a few millimetres wide and is perpendicular to the longitudinal axis 17. This is followed outwardly by a chamfer 41, which runs at 45° and merges on the outside with a circular-cylindrical centring wall 42. This is followed to the left by an annular groove 43, which receives in about half of its inner circumference an O-ring 44. The outer circumferential half projects outwards over the centring wall 42. Forcing away of the O-ring 44 to the left is guarded against by the inner surface 46 there of the bottom 37, which forms a circular ring. The O-ring 44 defines a sealing plane 47, which lies somewhat to the left or somewhat to the right of the sealing plane 47 drawn in FIG. 3, depending on the extent to which the said O-ring is compressed. To the left of the sealing plane 47, no matter how far to the left the latter is even in an extreme case, there is incorporated in the bottom 37 an annular channel 48, which merges with one side 49 with the inner surface 46, has a base 51 and reaches with its outer side 52 up to the internal thread 34.

On the inside, the annular wall 38 is bounded by a cylindrical wall 53, which is coaxial to the longitudinal axis 17 and merges by a 90° bend with the end face 39. The latter lies at about half the length of the shroud 33. The diameter of the cylindrical wall 53 is 40 mm, which is still quite considerably more than the inside diameter of a flexible spout 54, so that to this extent the flow resistance is not reduced.

The wall 53 tapers inwards by the same radius to merge with the bottom 37, which here has its original thickness and loses about half of its thickness in the region of the annular groove 43. Centrally and coaxially to the longitudinal axis 17, the bottom 37 has a through hole 56 of about 22 mm diameter. To the left of this lies a strainer 57, which is so fine-meshed that only liquid which has the necessary degree of purity can pass. Outside the radius of the through hole 56, there extends a coaxial, circular-cylindrical holding socket 58. The inner wall 59 of the latter holds the spout 54 liquid-tightly. This is achieved by adhesive. The inside diameter of the spout 54 corresponds approximately to the diameter of the through hole 56. To the right, the strainer 57 cannot move out of place due to a step 61 and to the left the inner end face 62 of the spout 54 is in the way. The spout 54 is a protective tube of galvanised steel, used for the laying of electric cables, with PVC sheathing and a clear width of 21.5 mm, as obtainable under the designation SL-PVC from Messrs. Albert Speck GmbH & Co., of 7530 Pforzheim.

In order to be able to empty a canister 11, the screw closure (not shown) is screwed off in the usual way. Then the device shown on the left in FIG. 3 is taken and screwed on in the same way as the closure cap has previously been screwed off. During this operation, the device 32 already centres itself at about half way along the internal thread 34 when screwing onto the external screw thread 18, so that consequently the required position is already reached. In the event of production inaccuracies, if the pouring nozzle 16 has become crushed or if there are any other inaccuracies of fit, a precentring is obtained by the chamfer 41 at the runout 22 of the internal thread 19 and a complete centring is obtained by the centring wall 42. On further screwing-on, the O-ring 44 comes into contact with the upper region of its inner surface 46, on the right according to FIG. 3, with the run-out 22 and is pressed increasingly against the inner surface 46 until liquidtightness is established. Depending on the degree of screwing-on or the design, the end face 21 then forms the continuation of the inner surface 46 and terminates the annular groove 43 to the right. The end 28 of the venting tube 27 is then in connection, in terms of air, with the annular groove 43 and the latter can suck air in via the through air hole 50. It is immaterial in this respect where the screwing movement of the device 32 ends, as the left end, according to FIG. 3, of the through hole 24 always opens out in the annular groove 43.

What is claimed is:

1. In a screw closure for a plastic canister, the plastic canister having a pouring nozzle that bears an external screw thread and one air venting through hole in a wall of the pouring nozzle, which opens into an end face of the pouring nozzle and leads to inside the canister, the screw closure comprising a screw closure shroud with an internal thread complementary to the external screw thread on the plastic canister and coaxial to a geometrical longitudinal axis of the screw closure, a screw closure bottom substantially perpendicular to the geometrical longitudinal axis, a coaxial annular wall having an outer wall region, emerging from the bottom and extending a distance shorter than the shroud, a coaxial sealing ring with an inner region held in defined contact by the outer wall region of the annular wall, and defining a sealing plane for the pouring nozzle, the improvement wherein (a) the annular wall resists radial forces from deforming the pouring nozzle, (b) on the far side of the sealing ring relative to the sealing plane, the screw closure bottom has an annular channel that is arranged coaxially, is open away from the screw closure bottom and extends widthwise between the annular wall and the shroud, (c) at least one through air hole is provided in the screw closure bottom and is positioned within the annular channel, (d) a liquid outflow hole is provided in the screw closure bottom within the annular wall, (e) downstream of the liquid outflow hole, a flexible pouring spout is connected in liquid-tight manner to the screw closure, (f) in a screwed-on position the sealing ring engages with an inner surface of the pouring nozzle, and (g) the annular channel is defined between an inner surface of the shroud and the outer wall region of the annular wall and communicates with the air venting through hole.

2. Screw closure according to claim 1, wherein the annular wall is solid.

3. Screw closure according to claim 1, wherein the annular wall has a free end region and on its outside in its free end region an introductory chamfer for an inner wall of the pouring nozzle.

4. Screw closure according to claim 1, wherein the sealing ring is of a size that does not cover at least substantial regions of the annular channel.

5. Screw closure according to claim 4, wherein the sealing ring has an outer wall region that reaches at most up to the inner rim of the annular channel.

6. Screw closure according to claim 5, wherein the sealing ring is an O-ring, the outer wall region of the annular wall holding the O-ring is a coaxial annular groove, and the O-ring lies in the annular groove under prestress.

7. Screw closure according to claim 6, wherein the annular wall has a free end region with an outside with an introductory chamfer, and a short, coaxial, circular-cylindrical centering wall is provided between the chamfer and the annular groove.

8. Screw closure according to claim 7, wherein the wall thickness of the annular wall in the region of the centering wall is 8 mm plus/minus 60%.

9. Screw closure according to claim 1, wherein the annular channel extends 360 degrees and a single air hole is provided.

10. Screw closure according to claim 1, wherein a liquid strainer is provided between the outflow hole and the screw closure-side end of the flexible pouring spout.

11. Screw closure according to claim 1, wherein the screw-closure bottom has an outside surface with a liquid-tight holding socket for the pouring spout.

12. Screw closure according to claim 10, wherein the screw closure is integral with the exception of the liquid strainer, the sealing ring and the pouring spout.

13. Screw closure according to claim 12, wherein the screw closure is injection-molded from plastic.

14. Screw closure according to claim 13, wherein the screw closure has externally the shape of screw closures with circumferential gripping protuberances.

15. Screw closure according to claim 1, wherein the screw closure has the characteristic dimensions of 20 liter canister screw closures and is injection-molded from plastic.

16. Screw closure according to claim 1, wherein on 20 liter canisters, the annular groove is 2.5 mm plus/-minus 60% deep and 8 mm plus/minus 60% wide.

17. Screw closure according to claim 1, wherein on 20 1 canisters, the center of the annular groove lies at a diameter of 35 mm plus/minus 5 mm.

18. In a screw closure for a plastic canister, the plastic canister having a pouring nozzle that bears an external screw thread, the screw closure comprising a screw closure shroud with an internal thread complementary to the external screw thread on the plastic canister and coaxial to a geometrical longitudinal axis of the screw closure, a screw closure bottom substantially perpendicular to the geometrical longitudinal axis, a coaxial annular wall having an outer wall region, emerging from the bottom and extending a distance shorter than the shroud, a coaxial sealing ring with an inner region held in defined contact by the outer wall region of the annular wall, and defining a sealing plane for the pouring nozzle, the improvement wherein (a) the annular wall resists radial forces from deforming the pouring nozzle, (b) on the far side of the sealing ring relative to the sealing plane, the screw closure bottom has an annular channel that is arranged coaxially, is open away from the screw closure bottom and extends widthwise between the annular wall and the shroud, (c) at least one through air hole is provided in the screw closure bottom, one end of which communicates with the annular channel, (d) a liquid outflow hole is provided in the screw closure bottom within the annular wall, (e) downstream of the liquid outflow hole, a flexible pouring spout is connected in liquid-tight manner to the screw closure, (f) the sealing ring has an outer wall region that reaches at most up to the inner rim of the annular channel, and (g) the sealing ring is an O-ring, the outer wall region of the annular wall holds the O-ring is a coaxial annular groove, and the O-ring lies in the annular groove under prestress.

19. Screw closure according to claim 18, wherein the annular wall has a free end region with an outside with an introductory chamfer, and a short, coaxial, circular-cylindrical centering wall is provided between the chamfer and the annular groove.

20. Screw closure according to claim 19, wherein the wall thickness of the annular wall in the region of the centering wall is 8 mm plus/minus 60%.

* * * * *